US009651880B2

(12) United States Patent
Miyamoto

(10) Patent No.: US 9,651,880 B2
(45) Date of Patent: May 16, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Masahiko Miyamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/834,944

(22) Filed: Aug. 25, 2015

(65) Prior Publication Data

US 2016/0216621 A1 Jul. 28, 2016

(30) Foreign Application Priority Data

Jan. 28, 2015 (JP) ..... 2015-014693

(51) Int. Cl.
*G03G 5/14* (2006.01)

(52) U.S. Cl.
CPC ..... *G03G 5/144* (2013.01)

(58) Field of Classification Search
CPC ..... G03G 5/144
USPC ..... 430/63, 65
See application file for complete search history.

(56) References Cited

U.S. PATENT DOCUMENTS 5,489,496 A 2/1996 Katayama et al.
8,178,266 B2 * 5/2012 Tada ..... G03G 5/0521 399/159
8,323,861 B2 * 12/2012 Mitsumori ..... G03G 5/043 430/56
8,404,411 B2 * 3/2013 Mitsumori ..... G03G 5/056 399/111
2006/0014092 A1 * 1/2006 Nukada ..... G03G 5/144 430/60
2013/0252147 A1 * 9/2013 Sugiura ..... G03G 5/144 430/56
2013/0316275 A1 * 11/2013 Kawasaki ..... G03G 5/144 430/56
2014/0178809 A1 * 6/2014 Matsusaki ..... G03G 5/144 430/60
2014/0377702 A1 * 12/2014 Nakahara ..... G03G 5/144 430/131

(Continued)

FOREIGN PATENT DOCUMENTS

JP H07-84393 A 3/1995
JP H09-230617 A 9/1997

(Continued)

OTHER PUBLICATIONS

English language machine translation of JP 2012-073353 (Apr. 2012).*

(Continued)

*Primary Examiner* — Christopher Rodee
(74) *Attorney, Agent, or Firm* — Oliff PLC

(57) ABSTRACT

An electrophotographic photoreceptor includes a conductive substrate, an undercoat layer provided on the conductive substrate and including metal oxide particles, and a photosensitive layer provided on the undercoat layer, wherein, at the time of performing Cole-Cole plot analysis with respect to the undercoat layer, an angular frequency ωmax, at which a maximum complex impedance component is obtained, falls within a range of 2 (rad)≤ωmax≤10 (rad).

8 Claims, 7 Drawing Sheets

(56) References Cited

U.S. PATENT DOCUMENTS

2015/0241800 A1* 8/2015 Tomono ..... G03G 5/144
430/56

FOREIGN PATENT DOCUMENTS

JP 2012073353 A * 4/2012
JP 2014153550 A * 8/2015

OTHER PUBLICATIONS

English language machine translation of JP 2014-153550 (Aug. 2015).*

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-014693 filed on Jan. 28, 2015.

BACKGROUND

1. Technical Field

The present invention relates to an electrophotographic photoreceptor, a process cartridge, and an image forming apparatus.

2. Related Art

An electrophotographic image forming apparatus may obtain high printing quality at high speed, and is used in an image forming apparatus such as a copying machine and a laser beam printer. As a photoreceptor used in the image forming apparatus, an organic photoreceptor using an organic photoconductive material is commonly used. When the organic photoreceptor is manufactured, for example, generally, an undercoat layer (also referred to as an "intermediate layer") is formed on a conductive substrate of aluminum or the like, and then a photosensitive layer is formed.

SUMMARY

According to an aspect of the invention, there is provided an electrophotographic photoreceptor including:

a conductive substrate;

an undercoat layer provided on the conductive substrate and including metal oxide particles; and a photosensitive layer provided on the undercoat layer, wherein, at the time of performing Cole-Cole plot analysis with respect to the undercoat layer, an angular frequency ωmax, at which a maximum complex impedance component is obtained, falls within a range of 2 (rad)≤ωmax≤10 (rad).

BRIEF DESCRIPTION OF THE DRAWINGS

Exemplary embodiments of the present invention will be described in detail based on the following figures, wherein.

DETAILED DESCRIPTION

Figure 1:
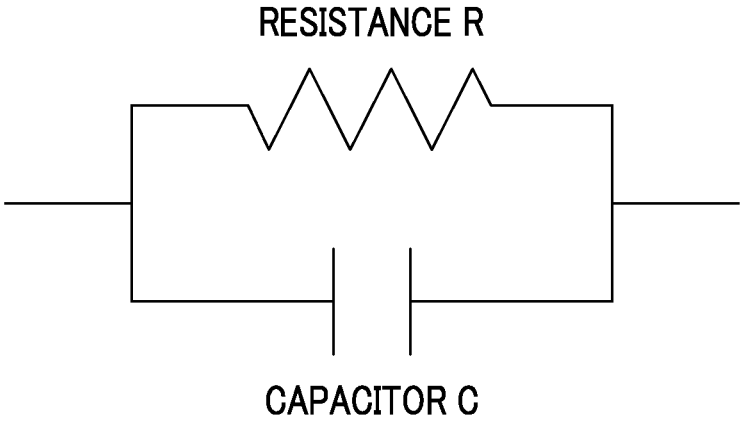
FIG. 1 is a schematic view illustrating a parallel circuit between resistance and a capacitor.

Hereinafter, an exemplary embodiment which is an example of the invention will be described in detail.

Electrophotographic Photoreceptor

An electrophotographic photoreceptor according to this exemplary embodiment (hereinafter, referred to as a "photoreceptor" in some cases) includes a conductive substrate, an undercoat layer, and a photosensitive layer. Further, the undercoat layer includes metal oxide particles, and, at the time of performing Cole-Cole plot analysis with respect to the undercoat layer, an angular frequency ωmax, at which the maximum complex impedance component is obtained (hereinafter, simply referred to as an "angular frequency ωmax" in some cases), falls within a range of 2 (rad) ≤ωmax≤10 (rad).

In the photoreceptor according to this exemplary embodiment, when the angular frequency ωmax is within the range described above, an occurrence of a streak-like image quality defect in an image having low image density (for example, 30%) (hereinafter, an image having low image density is referred to as a "halftone image" in some cases) is prevented. The reason why this occurs is not clear, but the following reasons are assumed.

In the electrophotographic image forming apparatus, as a method of charging the surface of the electrophotographic photoreceptor, a method of charging the surface of the photoreceptor by bringing a contact type charging unit (hereinafter, referred to as a "contact type charging device" in some cases) in contact with the surface of the photoreceptor is commonly used.

For example, in the image forming apparatus using the photoreceptor and the contact type charging device, a streak-like image quality defect (hereinafter, referred to as an "abnormal discharge image quality defect" in some cases) may occur on an output image in a right angle direction with respect to an output direction. The occurrence of the abnormal discharge image quality defect, in particular, is easily and remarkably observed at the time of outputting the entire surface halftone image (an image in which the entire surface of a recording medium is formed of a low density image).

In the image forming apparatus using the photoreceptor and the contact type charging device, when the surface of the photoreceptor is charged by the contact type charging device, abnormal discharge occurs with respect to the surface of the photoreceptor from the contact type charging device. When the abnormal discharge occurs, charging unevenness easily occurs on the surface of the photoreceptor, and as a result thereof, the abnormal discharge image quality defect easily occurs.

In addition, it is considered that the abnormal discharge which occurs with respect to the surface of the photoreceptor from the contact type charging device is caused due to an increase in charge movement between the contact type charging device and the surface of the photoreceptor. Further, the charge is moved from the conductive substrate of the photoreceptor to the surface of the photoreceptor, and thus the abnormal discharge more easily occurs.

Here, the undercoat layer containing the metal oxide particles has a function of preventing inflow of the charge from the conductive substrate to the photosensitive layer. However, when the charge is excessively moved in the undercoat layer, it is liable to be difficult to prevent the inflow of the charge to the photosensitive layer. In contrast, when it is too difficult that the charge is moved in the undercoat layer, image quality density easily decreases, and a performance as the photoreceptor is rarely exhibited.

The ease of movement of the charge in the undercoat layer may be estimated by the angular frequency ωmax providing the maximum complex impedance component at the time of performing the Cole-Cole plot analysis with respect to the undercoat layer.

That is, a decrease in the angular frequency ωmax indicates that the response speed of the charge with respect to an alternating-current voltage applied in the Cole-Cole plot analysis is reduced and the charge is not easily moved in the undercoat layer. In contrast, an increase in ωmax indicates that the charge is easily moved in the undercoat layer.

Further, by setting the angular frequency ωmax within the range described above, the ease of movement of the charge in the undercoat layer is suitably controlled, and thus it is considered that the occurrence of the abnormal discharge between the contact type charging device and the electrophotographic photoreceptor is prevented. As a result thereof, it is assumed that the occurrence of the abnormal discharge image quality defect (that is, the streak-like image quality defect) is prevented.

Furthermore, when the angular frequency ωmax is not in the range described above, the following phenomenon may be observed. When the angular frequency ωmax is greater than 10 (rad), the charge is excessively moved in the undercoat layer, the abnormal discharge easily occurs between the contact type charging device and the surface of the photoreceptor, and thus the abnormal discharge image quality defect easily occurs. In contrast, when the angular frequency ωmax is less than 2 (rad), the occurrence of the abnormal discharge image quality defect is easily prevented, but the charge is moved in the undercoat layer with increased difficulty, and the image quality density easily decreases.

Furthermore, the photoreceptor according to this exemplary embodiment includes the configuration described above, and thus even when the image forming apparatus to which the photoreceptor according to this exemplary embodiment is applied is used for a long period of time, the occurrence of the abnormal discharge image quality defect is prevented.

Here, the angular frequency ωmax providing the maximum complex impedance component (an imaginary number component Z" of an impedance Z) at the time of performing the Cole-Cole Plot analysis will be described.

For example, as an equivalent circuit of a conductive organic film configuring each layer of the electrophotographic photoreceptor, in general, a parallel circuit of resistance (a resistance value: R) and a capacitor (an electrostatic capacitance: C) is applied. As a method of analyzing and calculating the resistance value R and the electrostatic capacitance C in the parallel circuit in which the resistance value R and the electrostatic capacitance C are unclear, the Cole-Cole Plot analysis is included.

The Cole-Cole plot analysis is a method in which electrodes are attached to both ends of the parallel circuit (for example, the conductive organic film) having an unclear resistance value R and electrostatic capacitance C, an alternating-current voltage is applied between the both electrodes while changing the frequency thereof, and a phase relationship between the applied electric voltage and the obtained electric current is analyzed. According to this method, the resistance value R and the electrostatic capacitance C of the parallel circuit are obtained.

Hereinafter, the principle of measurement and analysis will be described.

In consideration of the parallel circuit illustrated in FIG. 1 (the parallel circuit of the resistance (the resistance value: R) and the capacitor (the electrostatic capacitance: C)), the impedance Z of the parallel circuit is denoted by Expression (I) described later. Here, i represents an imaginary number, and ω represents the angular frequency (rad) of the electric voltage applied to the parallel circuit.

$$1/Z=1/R+i\omega C \qquad \text{Expression (I)}$$

Next, Expression (I) is rewritten into Expression (II) described later as follows.

$$Z=R/(1+\omega^2R^2C^2)-i[\omega R^2C/(1+\omega^2R^2C^2)] \qquad \text{Expression (II)}$$

Here, when the impedance Z is denoted by using an actual number component Z' and an imaginary number component Z", the impedance Z is denoted by Expression (III) described later.

$$Z=Z'+iZ'' \qquad \text{Expression (III)}$$

In addition, each of the actual number component Z' and the imaginary number component Z" is denoted by Expression (IV) described later and Expression (V) described later.

$$Z'=R/(1+\omega^2R^2C^2) \qquad \text{Expression (IV)}$$

$$Z''=\omega R^2C/(1+\omega^2R^2C^2) \qquad \text{Expression (V)}$$

Then, when ω is eliminated from Expression (IV) and Expression (V), finally Expression (VI) described later is obtained.

$$(Z'-R/2)^2+Z''^2=(R/2)^2 \qquad \text{Expression (VI)}$$

Figure 2:
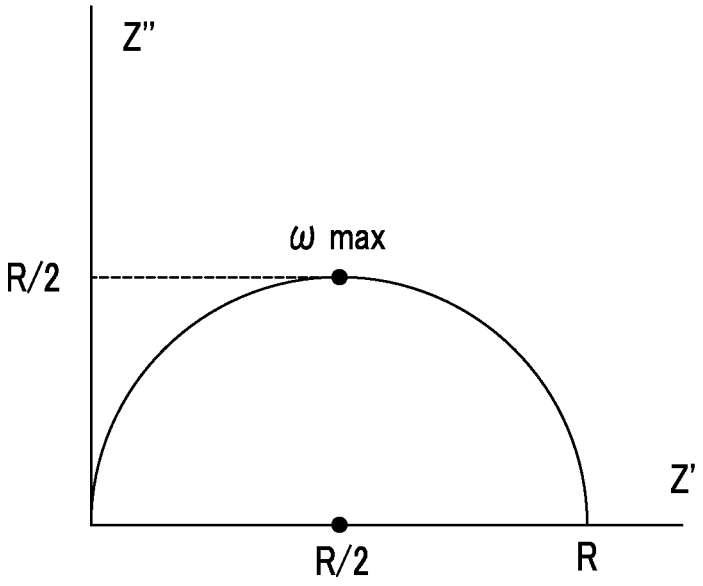
FIG. 2 is a diagram illustrating the concept of Cole-Cole plot analysis.

Expression (VI) indicates that the actual number component Z' and the imaginary number component Z" are in the shape of a semicircle on the basis of coordinates (R/2, 0) at the time of being shown as a diagram illustrated in a conceptual diagram of FIG. 2 by setting the imaginary number component Z" in a vertical axis and the actual number component Z' in a horizontal axis. Thus, the angular frequency at a point where the imaginary number component Z" is maximized is ωmax (rad), and this ωmax is a point where the electrostatic capacitance component is maximized.

That is, when the alternating-current voltage is applied to the parallel circuit having an unclear resistance value R and electrostatic capacitance C while changing the frequency thereof, the diagram as illustrated in FIG. 2 may be drawn from a phase difference between the absolute value of the obtained electric current and the applied electric voltage. Thus, the resistance value R and the angular frequency ωmax, and the electrostatic capacitance C are able to be calculated from this diagram.

Hereinafter, the electrophotographic photoreceptor according to this exemplary embodiment will be described in detail with reference to the drawings.

Figure 3:
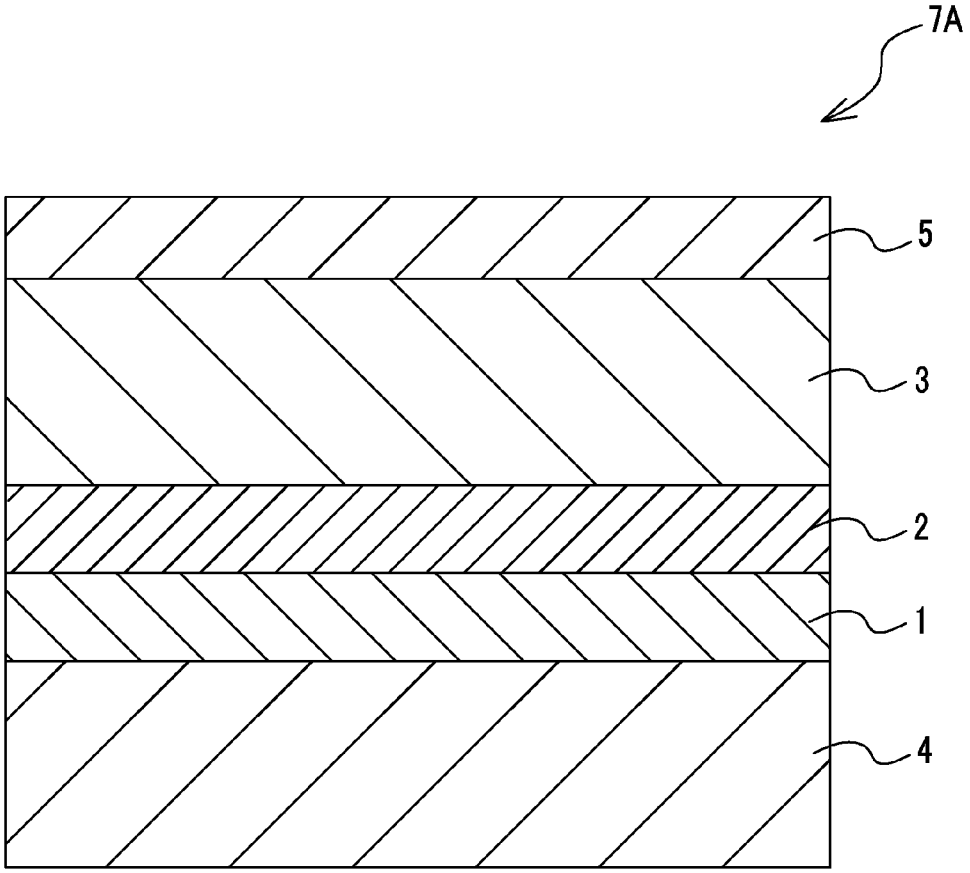
FIG. 3 is a schematic partial cross-sectional view showing an example of the layer configuration of the electrophotographic photoreceptor according to the present exemplary embodiment.
Figure 4:
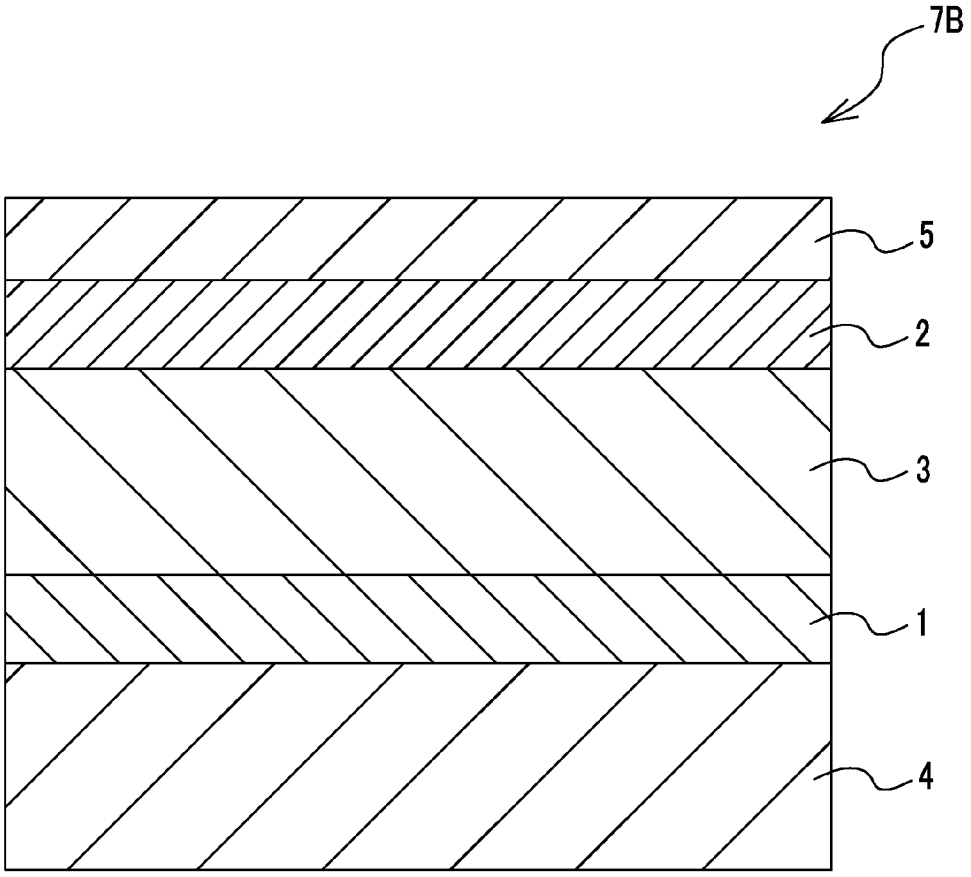
FIG. 4 is a schematic partial cross-sectional view showing another example of the layer configuration of the electrophotographic photoreceptor according to the present exemplary embodiment.
Figure 5:
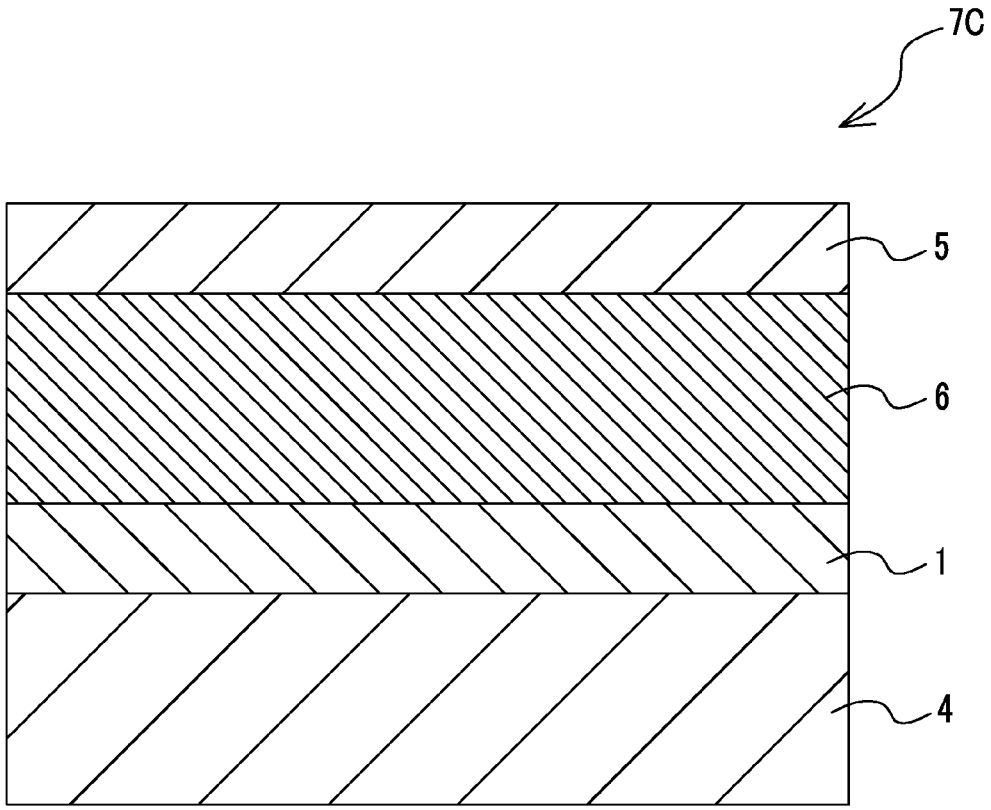
FIG. 5 is a schematic partial cross-sectional view showing still another example of the layer configuration of the electrophotographic photoreceptor according to the present exemplary embodiment.

FIG. 3 is a schematic cross-sectional view showing an example of the electrophotographic photoreceptor of the present exemplary embodiment. FIGS. 4 and 5 are each a schematic cross-sectional view showing another example of the electrophotographic photoreceptor according to the present exemplary embodiment.

An electrophotographic photoreceptor 7A shown in FIG. 3 is a so-called function separating type photoreceptor (or a lamination type photoreceptor) having a structure in which an undercoat layer 1 is provided on a conductive substrate 4, and a charge generating layer 2, a charge transport layer 3, and a protective layer 5 are sequentially formed thereon. In the electrophotographic photoreceptor 7A, a photosensitive layer is constituted with the charge generating layer 2 and the charge transport layer 3.

An electrophotographic photoreceptor 7B shown in FIG. 4 is a function separating type photoreceptor of which functions are separated into a charge generating layer 2 and a charge transport layer 3 similar to the electrophotographic photoreceptor 7A shown in FIG. 3.

The electrophotographic photoreceptor 7B shown in FIG. 4 has a structure in which an undercoat layer 1 is provided on the conductive substrate 4, and a charge transport layer 3, a charge generating layer 2, and a protective layer 5 are sequentially formed thereon. In the electrophotographic photoreceptor 7B, the photosensitive layer is constituted with the charge transport layer 3 and the charge generating layer 2.

An electrophotographic photoreceptor 7C shown in FIG. 5 includes a charge generating material and a charge transporting material in the same layer (the single layer type photosensitive layer 6). The electrophotographic photoreceptor 7C shown in FIG. 5 has a structure in which an undercoat layer 1 is provided on the conductive substrate 4, and a single layer type photosensitive layer 6 and a protective layer 5 are sequentially formed thereon.

Furthermore, in the electrophotographic photoreceptors 7A, 7B, and 7C shown in FIGS. 3, 4, and 5, a protective layer 5 is the outermost surface layer arranged farthest from the conductive substrate 4, and the outermost surface layer has the constitution as described above.

Each of the elements will be explained below based on electrophotographic photoreceptor 7A shown in FIG. 3 as a representative example. Further, the symbols are omitted in the explanations.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm to prevent interference fringes which are formed when irradiated by laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

Examples of the method for surface roughening include wet honing in which an abrasive suspended in water is blown onto a conductive substrate, centerless grinding in which continuous grinding is performed by pressing a conductive substrate onto a rotating grind stone, and anodic oxidation treatment.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal-based (for example, aluminum-based) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be inhibited.

The conductive substrate may be subjected to a treatment with an acidic aqueous solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness of the film is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

In the photoreceptor of this exemplary embodiment, the undercoat layer is configured by including the metal oxide particles. For example, the undercoat layer is a layer including the metal oxide particles and a binder resin. In addition, as described above, in this exemplary embodiment, the undercoat layer contains the metal oxide particles, and the angular frequency ωmax providing the maximum complex impedance component at the time of performing the Cole-Cole plot analysis with respect to the undercoat layer is 2 (rad)≤ωmax≤10 (rad).

From a viewpoint of further preventing the occurrence of the abnormal discharge image quality defect, it is preferable that the angular frequency ωmax is from 2 (rad) to 7.5 (rad). More preferably, the angular frequency ωmax is from 4.0 (rad) to 7.5 (rad).

A measurement method of the angular frequency ωmax providing the maximum complex impedance component at the time of performing the Cole-Cole plot analysis with respect to the undercoat layer is performed by using the following method.

As a power source, SI1287 electrochemical interface (manufactured by Toyo Corporation) is used, as an ammeter, SI1260 impedance/gain phase analyzer (manufactured by Toyo Corporation) is used, and as an electric current amplifier, 1296 dielectric interface (manufactured by Toyo Corporation) is used.

The conductive substrate (for example, an aluminum substrate) is used as a negative electrode, and a gold electrode is used as a positive electrode, and then an alternating-current impedance is measured by applying 1Vp-p of an alternating-current voltage from a high frequency side in a frequency range of 1 MHz to 1 mHz. According to a diagram of the Cole-Cole plot obtained from the measurement, the angular frequency ωmax is measured. Furthermore, when the same measurement as that with the device described above may be performed, the other measurement machine may be used.

Furthermore, as a method of measuring the angular frequency ωmax described above from the photoreceptor which is a measurement target, the following method is included.

First, the photoreceptor which is the measurement target is prepared. Next, for example, the photosensitive layer covering the undercoat layer such as a charge generating layer and a charge transport layer is removed by using a solvent such as acetone, tetrahydrofuran, methanol, and ethanol, and the undercoat layer is exposed. Then, the gold electrode is mounted on the exposed undercoat layer by using a method such as a vacuum deposition method, and a sputtering method, and thus a sample for measurement is obtained. Then, the angular frequency ωmax is measured with respect to the sample for measurement by using the measurement device described above.

In the photoreceptor of this exemplary embodiment, the angular frequency ωmax may be controlled, for example, by adjusting a particle diameter distribution of the metal oxide particles.

When the particle diameter distribution of the metal oxide particles increases, a distribution in a distance between metal oxide particles also increases. Then, the response speed with respect to the alternating-current voltage in the Cole-Cole plot analysis easily increases due to an influence of a component having a short distance between metal oxide particles. As a result thereof, the ωmax increases.

For example, when the undercoat layer is formed by forming a coating film of a coating liquid for forming an undercoat layer in which the metal oxide particles are dispersed, for example, there may be the metal oxide particles of secondary particles which are in a state where the primary particles are aggregated in a film of the undercoat layer along with primary particles. The metal oxide particles of the secondary particles have a particle diameter which is greater than that of the primary particles, and a path through which the charge is moved is easily formed due to the metal oxide particles of the secondary particles. Then, when the charge is excessively moved in the undercoat layer due to the metal oxide particles of the secondary particles, it is difficult to prevent the inflow of the charge into the photosensitive layer. In contrast, when the dispersion excessively progresses, and the metal oxide particles of the primary particles excessively increase in the undercoat layer, the charge is not easily moved, and thus the image quality density easily decreases. For this reason, by adjusting the particle diameter distribution, the ease of the movement of the charge in the undercoat layer is suitably adjusted, and thus it is possible to control the angular frequency ωmax to be in the range described above.

As an example of a method of adjusting the particle diameter distribution of the metal oxide particles, for example, a method of using the coating liquid for forming an undercoat layer in which a dispersion A of a first application liquid for forming an undercoat layer including first metal oxide particles and a dispersion B of a second application liquid for forming an undercoat layer including second metal oxide particles are mixed together is included.

Here, the particle diameter of the first metal oxide particles in the dispersion A is smaller than the particle diameter of the second metal oxide particles in the dispersion B.

As a method of adjusting the particle diameter distribution of the metal oxide particles, for example, specifically, the dispersion A is prepared in which the coating liquid for forming an undercoat layer having a known solid content concentration of the metal oxide particles is dispersed for a long period of time, in dispersing the metal oxide particles of the coating liquid for forming an undercoat layer. Next, the coating liquid for forming an undercoat layer having the same solid content concentration as that of the dispersion A is prepared, and the dispersion B is prepared in which the coating liquid for forming an undercoat layer is dispersed for a shorter period of time than the dispersion time of the dispersion A (for example, half of the dispersion time of the dispersion A).

Furthermore, the dispersion A is dispersed for a long period of time, and thus the particle diameter of the metal oxide particles in the dispersion A decreases. In contrast, when the dispersion B is dispersed for a short period of time, the particle diameter of the metal oxide particles in the dispersion B is larger than the particle diameter of the metal oxide particles in the dispersion A.

Next, the dispersion A described above and the dispersion B described above are mixed together, a weight ratio r (%) of the solid content of the metal oxide particles denoted by Expression (r) described later is adjusted, and thus it is possible to adjust the particle diameter distribution of the metal oxide particles. Then, the weight ratio r is adjusted, and thus it is possible to control the angular frequency ωmax.

$$r=\{A/(A+B)\}\times 100 \qquad \text{Expression (r)}$$

Here, in Expression (r), A represents the solid content (parts by weight) of the metal oxide particles in the dispersion A, and B represents the solid content (parts by weight) of the metal oxide particles in the dispersion B.

Furthermore, as described above, as an example of the dispersion time of the dispersion B, a case where the dispersion time of the dispersion B is half of the dispersion time of the dispersion A is described, but a difference between the dispersion time of the dispersion A and the dispersion time of the dispersion B is not particularly limited insofar as the angular frequency ωmax may be controlled in the range described above. In addition, a case where the solid content concentration of the metal oxide particles in the dispersion A and the solid content concentration of the metal oxide particles in the dispersion B are the same solid content concentration is described, but the solid content concentration is not particularly limited for the same reason.

Further, a method of mixing the coating liquid for forming an undercoat layer in which the metal oxide particles have a small particle diameter with the coating liquid for forming an undercoat layer in which the metal oxide particles have a large particle diameter is described as an example, but the method is not limited thereto.

As the metal oxide particles, for example, metal oxide particles having a powder resistance (volume resistivity) of $10^2$ Ωcm to $10^{11}$ Ωcm are included.

Among them, as the metal oxide particles having the resistance value described above, for example, tin oxide particles, titanium oxide particles, zinc oxide particles, zirconium oxide particles, and the like are included, and in particular, the zinc oxide particles are preferably used.

A specific surface area of the metal oxide particles which is obtained by using a BET method, for example, may preferably be greater than or equal to 10 $m^2/g$.

The volume average particle diameter of the metal oxide particles, for example, may be from 50 nm to 2000 nm (preferably, from 60 nm to 1000 nm).

The content of the metal oxide particles, for example, is preferably from 10% by weight to 80% by weight, and is more preferably from 40% by weight to 80% by weight, with respect to the binder resin.

The metal oxide particles may be subjected to a surface treatment. As the metal oxide particles, two or more types of metal oxide particles subjected to different surface treatments may be used by being mixed together.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either a dry method or a wet method.

It is preferable that the amount of the surface treatment agent used for the treatment, for example, is from 0.5% by weight to 10% by weight with respect to the metal oxide particles.

Here, the undercoat layer contains an electron acceptive compound (an acceptor compound) along with the metal oxide particles, and it is preferable from a viewpoint of long term stability of electric properties, and high carrier blocking properties.

Examples of the electron acceptive compound include electron transporting materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, amino anthraquinone compounds, aminohydroxyanthraquinone compounds, and the like are preferable, and specifically, anthraquinone, alizarin, quinizarin, anthrarufin, purpurin, and the like are preferable.

Among the compounds having an anthraquinone structure, from a viewpoint of the availability and electron transporting ability of the material or the like, a compound having an anthraquinone structure which has a hydroxyl group is particularly preferable. Furthermore, a compound having an anthraquinone structure which has not only a hydroxyl group but also an alkoxy group is preferable. The compound having an anthraquinone structure which has a hydroxyl group is a compound in which at least one hydrogen atom of the aromatic ring in the anthraquinone structure is substituted with a hydroxyl group, and it is more preferable that a compound denoted by the formula (1) or a compound denoted by the formula (2) described later is used. The compound denoted by the formula (1) described later is more preferable, and in particular, from a viewpoint of availability or handleability of the material or the like, it is particularly preferable that a compound denoted by Specific Example (1-9) of a compound described later is used.

Formula (1)

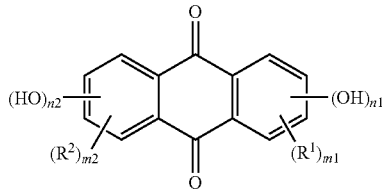

In the formula (1), n1 and n2 each independently represent an integer of 0 to 3. Here, at least one of n1 and n2 each independently represents an integer from 1 to 3 (that is, n1 and n2 do not simultaneously represent 0). m1 and m2 each independently represent an integer of 0 or 1. $R^1$ and $R^2$ each independently represent an alkyl group having 1 to 10 carbon atoms, or an alkoxy group having 1 to 10 carbon atoms.

Formula (2)

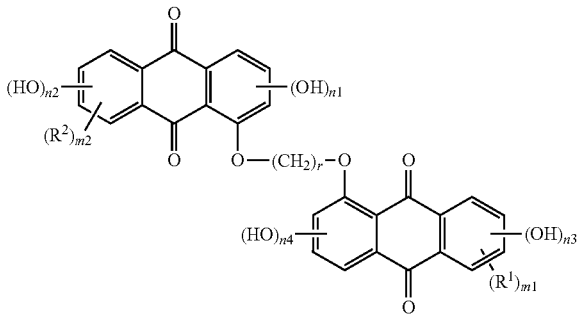

In the formula (2), n1, n2, n3, and n4 each independently represent an integer from 0 to 3. m1 and m2 each independently represent an integer of 0 or 1. At least one of n1 and n2 each independently represents an integer of 1 to 3 (that is, n1 and n2 do not simultaneously represent 0). At least one of n3 and n4 each independently represents an integer of 1 to 3 (that is, n3 and n4 do not simultaneously represent 0). r represents an integer from 2 to 10. $R^1$ and $R^2$ each independently represent an alkyl group having 1 to 10 carbon atoms, or an alkoxy group having 1 to 10 carbon atoms.

Here, in the formulae (1) and (2), the alkyl group having 1 to 10 carbon atoms represented by $R^1$ and $R^2$ may be either linear or branched, and as the alkyl group, for example, a methyl group, an ethyl group, a propyl group, an isopropyl group, and the like are included. As the alkyl group having 1 to 10 carbon atoms, an alkyl group having 1 to 8 carbon atoms is preferable, and an alkyl group having 1 to 6 carbon atoms is more preferable.

The alkoxy group having 1 to 10 carbon atoms represented by $R^1$ and $R^2$ may be either linear or branched, and as the alkoxy group, for example, a methoxy group, an ethoxy group, a propoxy group, an isopropoxy group, a butoxy group, an octoxy group, and the like are included. As the alkoxy group having 1 to 10 carbon atoms, an alkoxy group having 1 to 8 carbon atoms is preferable, and an alkoxy group having 1 to 6 carbon atoms is more preferable.

Here, a specific example of the electron acceptive compound is as follows. However, the electron acceptive compound is not limited thereto.

Furthermore, the following specific example of the compound is referred to as an "illustrative compound", and for example, a compound of (1-1) described later is referred to as "Illustrative Compound (1-1)".

In addition, in the following illustrative compound, "Me" represents a methyl group, "Et" represents an ethyl group, "Bu" represents a n-butyl group, and "$C_8H_{17}$" represents a n-octyl group.

1-1

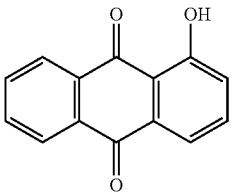

1-2

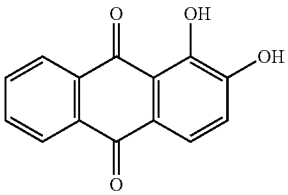

1-3

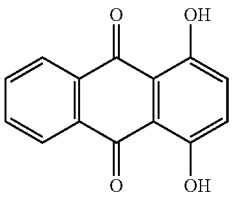

-continued 1-4

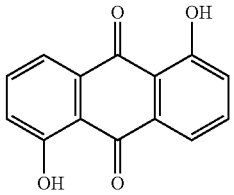

1-5

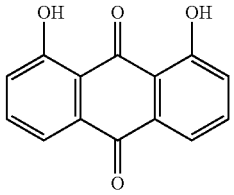

1-6

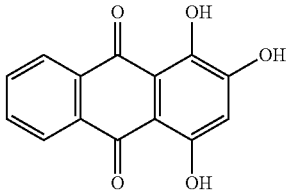

1-7

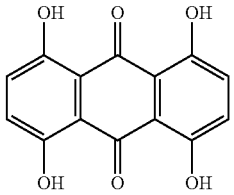

1-8

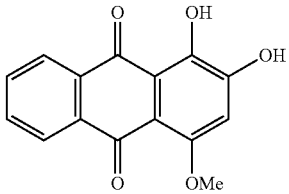

1-9

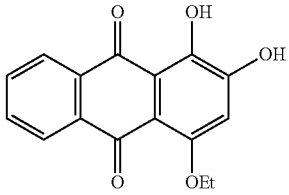

1-10

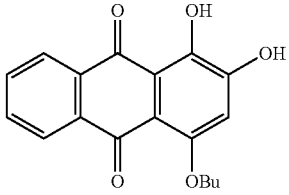

1-11

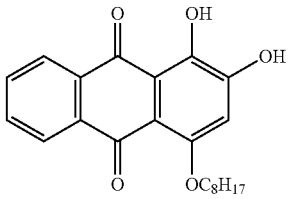

-continued
1-12
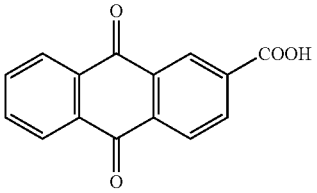
1-13
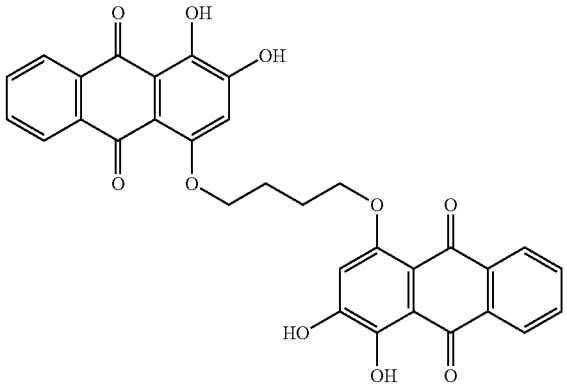
1-14
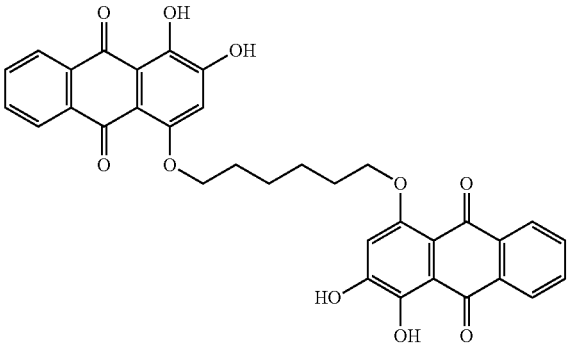
1-15
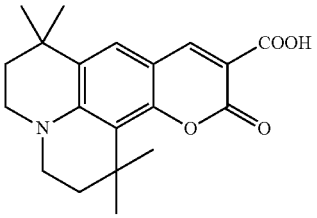
1-16
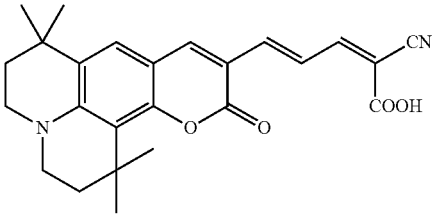
-continued
1-17
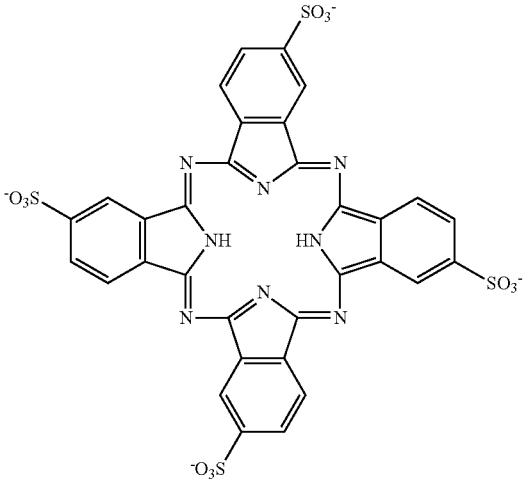
1-18
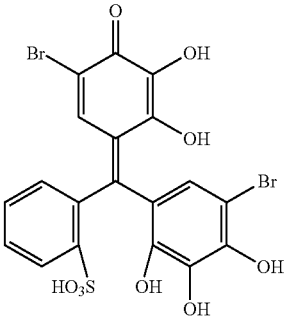
1-19
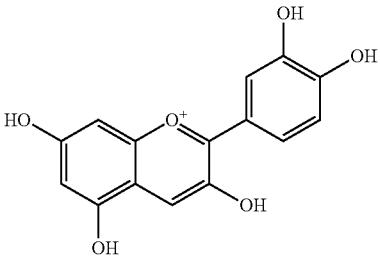
1-20
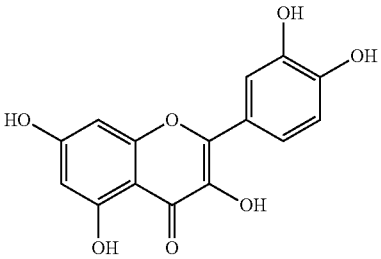
1-21
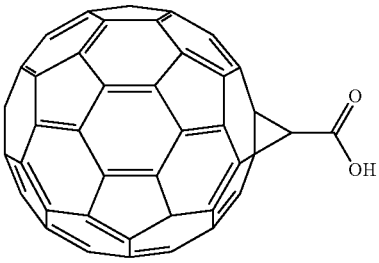

-continued 1-22

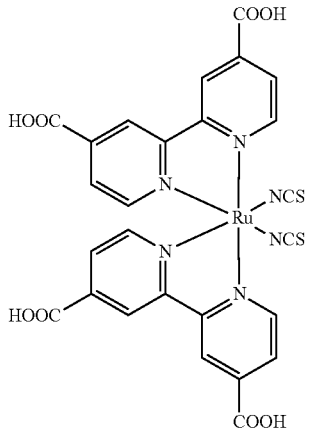

The electron acceptive compound may be included in the undercoat layer by being dispersed along with the metal oxide particles, or may be included in a state of being attached to the surface of the metal oxide particles.

As a method of attaching the electron acceptive compound to the surface of the metal oxide particles, for example, a dry method or a wet method is included.

The dry method, for example, is a method in which while stirring the metal oxide particles using a mixer having a large shear force or the like, the electron acceptive compound is directly dropped or the electron acceptive compound dissolved in an organic solvent is dropped, and is sprayed along with dry air or nitrogen gas, and thus the electron acceptive compound is attached to the surface of the metal oxide particles. The electron acceptive compound may be dropped or may be sprayed at a temperature lower than or equal to the boiling point of the solvent. After the electron acceptive compound is dropped or is sprayed, baking may be further performed at a temperature of higher than or equal to 100° C. The temperature and time for baking is not particularly limited insofar as electrophotographic properties are able to be obtained.

The wet method, for example, is a method in which the electron acceptive compound is added while dispersing the metal oxide particles in the solvent by using a stirrer, ultrasonic waves, a sand mill, an attritor, a ball mill, or the like, and is stirred or dispersed, and then the solvent is removed, and thus the electron acceptive compound is attached to the surface of the metal oxide particles. In a solvent removal method, for example, the solvent is distilled away by filtration or distillation. After the solvent is removed, baking may be further performed at a temperature of higher than or equal to 100° C. The temperature and time for baking is not particularly limited insofar as electrophotographic properties are able to be obtained. In the wet method, the moisture contained in the metal oxide particles may be removed before the electron acceptive compound is added, and as an example thereof, a method of removing the contained moisture while being stirred and heated in the solvent, and a method of removing the contained moisture by allowing the solvent to be azeotropic are included.

Furthermore, the attachment of the electron acceptive compound may be performed before or after a surface treatment is performed with respect to the metal oxide particles by using a surface treatment agent, or the attachment of the electron acceptive compound and the surface treatment using the surface treatment agent may be simultaneously performed.

The content of the electron acceptive compound, for example, may be from 0.01% by weight to 20% by weight, and is preferably from 0.01% by weight to 10% by weight, with respect to the metal oxide particles.

Examples of the binder resin used in the undercoat layer include known materials, such as well-known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binder resin used in the undercoat layer include charge transporting resins having charge transporting groups, and conductive resins (for example, polyaniline).

Among these, as the binder resin used in the undercoat layer, a resin which is insoluble in a coating solvent of an upper layer is suitable, and particularly, thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable.

In the case where these binder resins are used in combination of two or more kinds thereof, the mixing ratio is set as appropriate.

In order to improve electric properties, environmental stability, and an image quality, various additives may be included in the undercoat layer.

Examples of the additive include a known material such as a polycyclic condensed or an azo-based electron transport pigment, a zirconium chelate compound, a titanium chelate compound, an aluminum chelate compound, a titanium alkoxide compound, an organic titanium compound, and a silane coupling agent. As described above, the silane coupling agent is used in the surface treatment of the metal oxide particles, and may be further added to the undercoat layer as the additive.

Examples of the silane coupling agent as an additive include vinyltrimethoxysilane, 3-methacryloxypropyl-tris(2-methoxyethoxy)silane, 2-(3, 4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more kinds thereof.

The Vickers hardness of the undercoat layer is preferably 35 or more.

The surface roughness of the undercoat layer (ten point height of irregularities) is adjusted in the range of from (¼) $n\lambda$ to (½)$\lambda$, in which $\lambda$ represents the wavelength of the laser for exposure to be used and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buffing grinding, a sandblasting treatment, wet honing, and a grinding treatment.

The formation of the undercoat layer is not particularly limited insofar as the angular frequency $\omega max$ may be controlled in the range described above, and for example, the undercoat layer is formed by forming the coating film of the coating liquid for forming an undercoat layer in which the component described above is added to the solvent, by drying the coating film, and as necessary, by heating the coating film. As an example of the coating liquid for forming an undercoat layer, the coating liquid for forming an undercoat layer described above may be preferably used. That is, the coating liquid for forming an undercoat layer which is prepared by mixing the dispersion A of the first application liquid for forming an undercoat layer containing the first metal oxide particles with the dispersion B of the second application liquid for forming an undercoat layer containing the second metal oxide particles in which the particle diameter of the first metal oxide particles is smaller than the particle diameter of the second metal oxide particles may be preferably used.

Examples of the solvent for forming the coating liquid for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Examples of these solvents specifically include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

As a dispersion method of the metal oxide particles at the time of preparing the coating liquid for forming an undercoat layer, for example, known methods such as those using a roll mill, a ball mill, a vibration ball mill, an attritor, a sand mill, a colloid mill, or a paint shaker are included.

Further, examples of a method for coating the coating liquid for forming an undercoat layer onto a conductive substrate include ordinary methods such as a blade coating method, a wire bar coating method, a spraying method, a dipping coating method, a bead coating method, an air knife coating method, and a curtain coating method.

The film thickness of the undercoat layer is set to be, for example, preferably 15 μm or more, and more preferably in a range of from 18 μm to 50 μm.

Intermediate Layer

Although not shown in the figures, an intermediate layer may be further provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organometallic compound. Examples of the organometallic compound used in the intermediate layer include organometallic compounds containing a metal atom such as zirconium, titanium, aluminum, manganese, and silicon.

These compounds used in the intermediate layer may be used singly or as a mixture or a polycondensate of plural compounds.

Among these, layers containing organometallic compounds containing a zirconium atom or a silicon atom are preferable.

The formation of the intermediate layer is not particularly limited, and well-known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spraying method, a blade coating method, a knife coating method, and a curtain coating method are used.

The film thickness of the intermediate layer is set to, for example, preferably from 0.1 μm to 3 μm. Further, the intermediate layer may be used as an undercoat layer.

Charge Generating Layer

The charge generating layer is, for example, a layer including a charge generating material and a binder resin. Further, the charge generating layer may be a layer in which a charge generating material is deposited. The layer in which the charge generating material is deposited is suitable for a case where a non-interfering light source such as a light emitting diode (LED) and an organic electro-luminescence (EL) image array is used.

Examples of the charge generating material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these, in order to corresponding to laser exposure in the near-infrared region, it is preferable to use metal or metal-free phthalocyanine pigments as the charge generating material, and specifically, hydroxygallium phthalocyanine, chlorogallium phthalocyanine, ichlorotin phthalocyanine, and titanyl phthalocyanine are more preferable.

On the other hand, in order to corresponding to laser exposure in the near-ultraviolet region, as the charge generating material, condensed aromatic pigments such as dibromoanthanthrone; thioindigo pigments; porphyrazine compounds; zinc oxides; trigonal selenium; bisazo pigments; and the like are preferable.

In the case of using non-interfering light sources such as LED having a light emitting center wavelength at 450 nm to 780 nm and organic EL image arrays, the above charge generating materials may be used, but from the viewpoint of resolution, when a photosensitive layer is used as a thin film having a thickness of 20 μm or less, the electrical strength in the photosensitive layer increases, and thus, a decrease in charging by charge injection from a substrate, or image defects such as so-called a black spots are easily generated. This becomes apparent when using a charge generating material easily causing generation of dark currents as a p-type semiconductor such as trigonal selenium and phthalocyanine pigment.

Contrary to this, in the case where n-type semiconductors such as condensed aromatic pigments, perylene pigments, azo pigments are used as a charge generating material, dark currents are not easily generated, and image defects called as a black spot may be prevented even when used as a thin film. Examples of the n-type charge generating material include the compounds (CG-1) to (CG-27) in paragraph Nos. [0288] to [0291] of JP-A-2012-155282, but are not limited thereto.

In addition, determination of n-type ones may be conducted as follows: by employing a time-of-flight method commonly used, with the polarity of photocurrents, those in which electrons are easily flown out than holes as a carrier are determined as an n-type one.

The binder resin used in the charge generating layer may be selected from a wide range of insulating resins, and further, the binder resin may be selected from organic photoconductive polymers such as poly-N-vinyl carbazole, polyvinyl anthracene, polyvinyl pyrene, and polysilane.

Examples of the binder resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein resins, polyvinyl alcohol resins, and polyvinyl pyrrolidone resins. The term "insulating" herein means that the volume resistivity is $10^{13}$ Ωcm or more.

These binder resins may be used singly or as a mixture of two or more kinds thereof.

Furthermore, the blending ratio of the charge generating material and the binder resin is preferably in the range of 10:1 to 1:10 by weight ratio.

In addition, well-known additives may be included in the charge generating layer.

The formation of the charge generating layer is not particularly limited, and well-known forming methods are used. However, the formation of the charge generating layer is carried out by, for example, forming a coating film of a coating liquid for forming a charge generating layer, the coating liquid obtained by adding the components above to a solvent, and drying the coating film, followed by heating, as desired. Further, the formation of the charge generating layer may also be carried out by deposition of a charge generating material. The formation of charge generating layer by deposition is particularly suitable for a case of using a condensed aromatic pigment or a perylene pigment as a charge generating material.

Examples of the solvent used for the preparation of coating liquid for forming a charge generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used singly or as a mixture two or more kinds thereof.

For a method for dispersing particles (for example charge generating materials) in the coating liquid for forming a charge generating layer, for example, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion liquid to collide against liquid or against walls under a high pressure, and a penetration system in which the particles are dispersed by causing the dispersion liquid to penetrate through a fine flow path under a high pressure.

In addition, the average particle diameter of the charge generating materials in the coating liquid for forming a charge generating layer during the dispersion is effectively 0.5 μm or less, preferably 0.3 μm or less, and more preferably 0.15 μm or less.

Examples of a method for coating the coating liquid for forming a charge generating layer onto the undercoat layer (or an intermediate layer) include ordinary methods such as a blade coating method, a wire bar coating method, a spraying method, a dipping coating method, a bead coating method, an air knife coating method, and a curtain coating method.

The film thickness of the charge generating layer is set to be, for example, in a range of preferably from 0.1 μm to 5.0 μm, and more preferably from 0.2 μm to 2.0 μm.

Charge Transport Layer

The charge transport layer is, for example, a layer including a charge transporting material and a binder resin. The charge transport layer may be a layer including a polymeric charge transporting material.

Examples of the charge transporting material include electron transporting compounds, such as quinone compounds such as p-benzoquinone, chloranil, bromanil, and anthraquinone; tetracyanoquinodimethane compounds; fluorenone compounds such as 2,4,7-trinitro fluorenone; xanthone compounds; benzophenone compounds; cyanovinyl compounds; and ethylene compounds. Other examples of the charge transporting material include hole transporting compounds such as triarylamine compounds, benzidine compounds, arylalkane compounds, aryl substituted ethylene compounds, stilbene compounds, anthracene compounds, and hydrazone compounds. These charge transporting materials may be used alone or in combination of two or more kinds thereof, but are not limited thereto.

The charge transporting material is preferably a triaryl amine derivative represented by the following formula (a-1) and a benzidine derivative represented by the following formula (a-2) from the viewpoint of charge mobility.

(a-1)

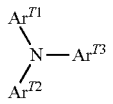

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$, and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

(a-2)

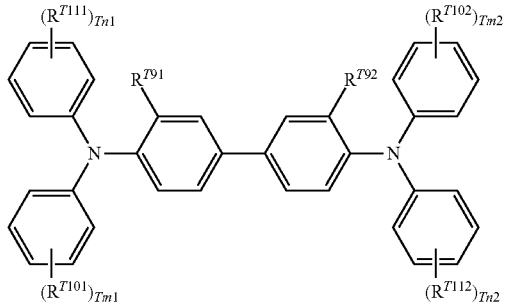

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$ or $—CH=CH—CH=C(R^{T15})(R^{T16})$; $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group; and Tm1, Tm2, Tn1 and Tn2 each independently represent an integer of 0 to 2.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

Here, among the triarylamine derivatives represented by the formula (a-1) and the benzidine derivatives represented by the formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are particularly preferable from the viewpoint of charge mobility.

As the polymeric charge transporting material, a known material having charge transporting properties such as poly-N-vinyl carbazole, and polysilane is used. In particular, a polyester polymeric charge transporting material is particularly preferable. Furthermore, the polymeric charge transporting material may be independently used, or may be used by being combined with the binder resin.

As the binder resin used in the charge transport layer, a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinyl carbazole, polysilane, and the like are included. Among them, as the binder resin, the polycarbonate resin or the polyarylate resin is preferable. One of the binder resins may be independently used or two or more thereof may be used.

Furthermore, it is preferable that the blending ratio of the charge transporting material to the binder resin is 10:1 to 1:5 by weight ratio.

In addition, well-known additives may be included in the charge transport layer.

The formation of the charge transport layer is not particularly limited, and well-known forming methods are used. The formation of the charge transport layer is carried out by, for example, forming a coating film of a coating liquid for forming a charge transport layer, the coating liquid obtained by adding the components above to a solvent, and drying the coating film, followed by heating, as desired.

Examples of the solvent used for the coating liquid for forming the charge transport layer include ordinary organic solvents, such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used singly or in combination of two or more kinds thereof.

Examples of a method for coating the coating liquid for forming a charge transport layer onto the charge generating layer include ordinary methods such as a blade coating method, a wire bar coating method, a spraying method, a dipping coating method, a bead coating method, an air knife coating method, and a curtain coating method.

The film thickness of the charge transport layer is set to be, for example, in a range of preferably 5 μm to 50 μm and more preferably 10 μm to 30 μm.

Protective Layer

The protective layer is provided on the photosensitive layer, as necessary. The protective layer, for example, is provided in order to prevent a chemical change in the photosensitive layer at the time of charging, or to further improve the mechanical strength of the photosensitive layer.

For this reason, as the protective layer, a layer configured of a curable film (a cross-linked film) may preferably be applied. As such a layer, for example, the following layer indicated by 1) or 2) is included.

1) A layer configured of a curable film of a composition including a reactive group-containing charge transporting material in which a reactive group and a charge transporting skeleton are included in one molecule (that is, a layer including a polymerized product or a cross-linked product of the reactive group-containing charge transporting material)

2) A layer configured of a curable film of a composition including a non-reactive charge transporting material and a reactive group-containing non-charge transporting material which includes a reactive group and does not include a charge transporting skeleton (that is, a layer including a polymerized product or a cross-linked product of the non-reactive charge transporting material and the reactive group-containing non-charge transporting material)

As the reactive group of the reactive group-containing charge transporting material, a known reactive group such as a chain-polymerizable group, an epoxy group, —OH, —OR [here, R represents an alkyl group], —$NH_2$, —SH, —COOH, and —$SiR^{Q1}_{3-Qn}(OR^{Q2})_{Qn}$ [here, $R^{Q1}$ represents a hydrogen atom, an alkyl group, or a substituted or non-substitute aryl group, $R^{Q2}$ represents a hydrogen atom, an alkyl group, or a trialkylsilyl group, and Qn represents an integer of 1 to 3] is included.

The chain-polymerizable group is not particularly limited insofar as the chain-polymerizable group is a functional group which may be subjected to radical polymerization, and as the chain-polymerizable group, for example, a functional group having a group containing at least a carbon double bond. Specifically, groups containing at least one selected from a vinyl group, a vinyl ether group, a vinyl thioether group, a styryl group, an acryloyl group, a methacryloyl group, and derivatives thereof are included. Among them, as the chain-polymerizable group, a group containing at least one selected from the vinyl group, the styryl group, the acryloyl group, the methacryloyl group, and the derivatives thereof is preferable from a viewpoint of excellent reactive properties.

The charge transporting skeleton of the reactive group-containing charge transporting material is not particularly limited insofar as the charge transporting skeleton is a known structure of the electrophotographic photoreceptor, and as the charge transporting skeleton, for example, a skeleton derived from a nitrogen-containing hole transporting compound such as a triarylamine compound, a benzidine compound, and a hydrazone compound which is conjugated with a nitrogen atom is included. Among them, the triarylamine skeleton is preferable.

The reactive group-containing charge transporting material having the reactive group and the charge transporting skeleton, the non-reactive charge transporting material, and the reactive group-containing non-charge transporting material may be selected from a known material.

In addition, a known additive may be included in the protective layer.

The formation of the protective layer is not particularly limited, but a known forming method is used, and for example, the protective layer is formed by forming a coating film of a coating liquid for forming a protective layer in which the component described above is added to a solvent, by drying the coating film, and as necessary, by performing a curing treatment such as heating.

As the solvent for preparing the coating liquid for forming a protective layer, an aromatic solvent such as toluene, and xylene; a ketone solvent such as methyl ethyl ketone, methyl isobutyl ketone, and cyclohexanone; an ester solvent such as ethyl acetate, and butyl acetate; an ether solvent such as tetrahydrofuran, and dioxane; a cellosolve solvent such as ethylene glycol monomethyl ether; an alcohol solvent such as isopropyl alcohol, and butanol, and the like are included. One of these solvents may be independently used or two or more thereof may be used by being mixed together.

Furthermore, the coating liquid for forming a protective layer may be a solventless application liquid.

As a method of applying the coating liquid for forming a protective layer onto the photosensitive layer (for example, the charge transport layer), common methods such as a dipping coating method, an extrusion coating method, a wire bar coating method, a spray coating method, a blade coating method, a knife coating method, and a curtain coating method are included.

The film thickness of the protective layer, for example, is preferably set to be in a range of 1 μm to 20 μm, and is more preferably set to be in a range of 2 μm to 10 μm.

Single Layer Type Photosensitive Layer

The single layer type photosensitive layer (the charge generating/charge transport layer), for example, is a layer including a charge generating material and a charge transporting material, and as necessary, the binder resin, and the other known additive. Furthermore, the material is identical to the material described in the charge generating layer and the charge transport layer.

Further, in the single layer type photosensitive layer, the content of the charge generating material may be from 10% by weight to 85% by weight, and is preferably from 20% by weight to 50% by weight, with respect to the total amount of solid content. In addition, in the single layer type photosensitive layer, the content of the charge transporting material may be from 5% by weight to 50% by weight with respect to the total amount of solid content.

A forming method of the single layer type photosensitive layer is identical to the forming method of the charge generating layer or the charge transport layer.

The film thickness of the single layer type photosensitive layer, for example, may be from 5 μm to 50 μm, and is preferably from 10 μm to 40 μm.

Image Forming Apparatus (and Process Cartridge)

The image forming apparatus according to this exemplary embodiment includes an electrophotographic photoreceptor, a contact charging type charging unit charging a surface of the electrophotographic photoreceptor, an electrostatic latent image forming unit forming an electrostatic latent image on the surface of the charged electrophotographic photoreceptor, a developing unit developing the electrostatic latent image formed on the surface of the electrophotographic photoreceptor by using a developer including a toner to form a toner image, and a transfer unit transferring the toner image to a surface of a recording medium. Further, as the electrophotographic photoreceptor, the electrophotographic photoreceptor according to this exemplary embodiment is applied.

As the image forming apparatus according to the present exemplary embodiment, known image forming apparatuses provided with a device including a fixing unit that fixes a toner image transferred to a surface of a recording medium; a direct transfer type device that directly transfers the toner image formed on the surface of the electrophotographic photoreceptor to a recording medium; an intermediate transfer type device that primarily transfers the toner image formed on the surface of the electrophotographic photoreceptor to the surface of an intermediate transfer member, and secondarily transfers the toner image transferred to the surface of the intermediate transfer member to the surface of the recording medium; a device provided with a cleaning unit that cleans the surface of the electrophotographic photoreceptor, after the transfer of the toner image and before charging; a device provided with an erasing unit that erases charges by irradiating the surface of an image holding member with erasing light after the transfer of the toner image and before charging; a device provided with an electrophotographic photoreceptor heating unit that increases the temperature of the electrophotographic photoreceptor to reduce the relative temperature; and the like are applied.

In the case of the intermediate transfer type device case, for the transfer unit, for example, a configuration in which a intermediate transfer member to the surface of which the toner image is transferred, a first transfer unit that primarily transfers a toner image formed on the surface of an image holding member to the surface of the intermediate transfer member, and a secondary transfer unit that secondarily transfers the toner image transferred to the surface of the intermediate transfer member to the surface of the recording medium is applied.

The image forming apparatus according to the present exemplary embodiment is any one of a dry development type image forming apparatus and a wet development type (development type using a liquid developer) image forming apparatus.

Furthermore, in the image forming apparatus according to the present exemplary embodiment, for example, a part provided with the electrophotographic photoreceptor may be a cartridge structure (process cartridge) that is detachable from an image forming apparatus. As the process cartridge, for example, a process cartridge including the electrophotographic photoreceptor according to the present exemplary embodiment is suitably used. Further, the process cartridge may include, in addition to the electrophotographic photoreceptor, for example, at least one selected from the group consisting of a charging unit, an electrostatic latent image forming unit, a developing unit, and a transfer unit.

Hereinafter, one example of the image forming apparatuses according to the present exemplary embodiment is shown, but the present invention is not limited thereto. Further, the main parts shown in the figures are described, and explanation of the others will be omitted.

Figure 6:
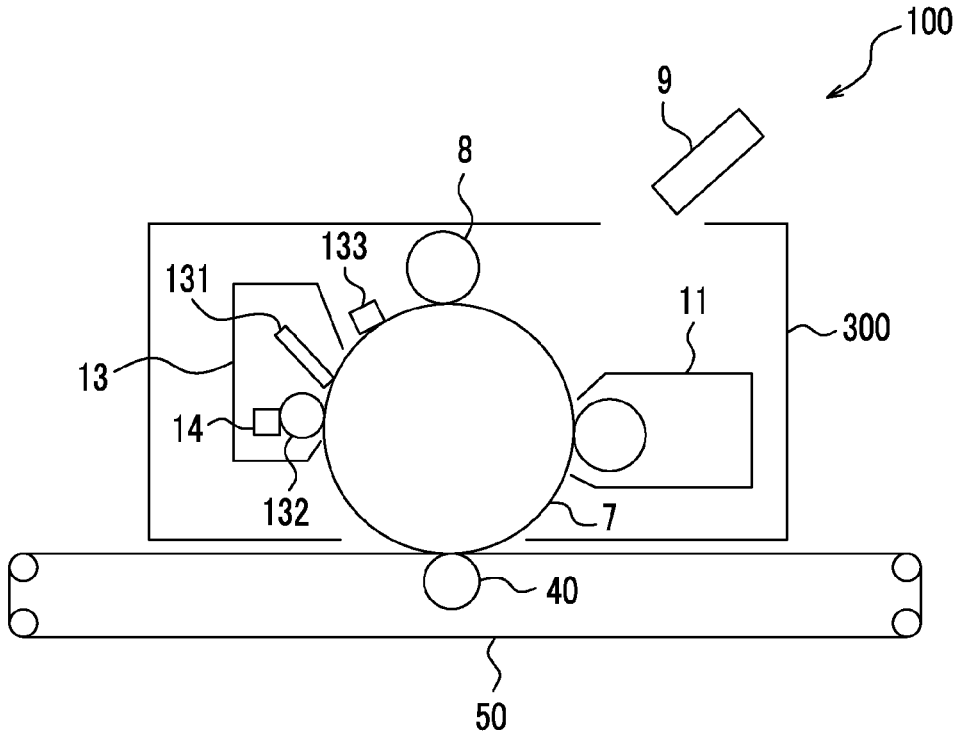
FIG. 6 is a schematic configuration diagram showing an example of the image forming apparatus according to the present exemplary embodiment.

FIG. 6 is a schematic configuration diagram showing an example of the image forming apparatus according to the present exemplary embodiment.

The image forming apparatus 100 according to the present exemplary embodiment is provided with a process cartridge 300 provided with an electrophotographic photoreceptor 7 as shown in FIG. 6, an exposure device 9 (an example of the electrostatic latent image forming unit), a transfer device 40 (primary transfer device), and an intermediate transfer member 50. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to be in partial contact with the electrophotographic photoreceptor 7. Further, although not shown in the figure, the apparatus also includes a secondary transfer device that transfers a toner image transferred onto the intermediate transfer member 50 to a recording medium (for example, paper). Further, the intermediate transfer member 50, the transfer device 40 (primary transfer device), and the secondary transfer device (not shown) correspond to an example of the transfer unit.

The process cartridge 300 of FIG. 6 integrally supports the electrophotographic photoreceptor 7, the contact charging type charging device 8 (an example of the charging unit), the developing device 11 (an example of the developing unit), and the cleaning device 13 (an example of the cleaning unit) in a housing. The cleaning device 13 includes a cleaning blade (an example of the cleaning member) 131, and the cleaning blade 131 is arranged to contact with the surface of the electrophotographic photoreceptor 7. Furthermore, the cleaning member may not have the same aspects as the cleaning blade 131, but may be a conductive or insulating fibrous member, and the fibrous member may be independently used or may be used in combination of the cleaning blade 131.

Furthermore, in FIG. 6, as the image forming apparatus, an example is illustrated in which a fibrous member 132 (in the shape of a roll) supplying antifriction 14 onto the surface of the electrophotographic photoreceptor 7, and a fibrous member 133 (in the shape of a flat brush) aiding in the cleaning are included, however, these fibrous members are arranged, as necessary.

Hereinafter, each configuration of the image forming apparatus according to this exemplary embodiment will be described.

Charging Device

The charging device 8 is connected to a power source (not illustrated), an electric voltage is applied by the power source, and thus the surface of the electrophotographic photoreceptor 7 is charged. As the charging device 8, the contact charging type charging device (an example of the charging unit) for charging the surface of the photoreceptor is used. As the contact charging type charging device, for example, a member for contact charging using a conductive or a semi-conductive charging roller, a charging brush, a charging film, a charging rubber blade, a charging tube, and the like is used.

The member for contact charging is arranged to contact with the surface of the photoreceptor, an electric voltage is directly applied to the photoreceptor, and thus the surface of the photoreceptor is charged to a predetermined electric potential. As the member for contact charging, those are member is used in which metal oxide particles of carbon black, copper iodide, silver iodide, zinc sulfide, silicon carbide, metal oxide, and the like are dispersed in a metal such as aluminum, iron, and copper, a conductive high molecular material such as polyacetylene, polypyrrole, and polythiophene, and an elastomer material such as polyurethane rubber, silicone rubber, epichlorohydrin rubber, ethylene propylene rubber, acrylic rubber, fluororubber, styrene butadiene rubber, and butadiene rubber.

As an example of metal oxide used in the member for contact charging, $Z_2O$, $SnO_2$, $TiO_2$, $In_2O_3$, $MoO_3$, or composite oxides thereof are included. In addition, conductivity may be applied to the elastomer material by adding perchlorate thereto.

Further, a covering layer may be preferably provided on the surface. As a material of forming the covering layer, N-alkoxy methylated nylon, a cellulose resin, a vinyl pyridine resin, a phenol resin, polyurethane, polyvinyl butyral, melamine, and the like are included. These materials for forming the covering layer may be independently used, or two or more thereof may be used in combination.

In addition, an emulsion resin material (for example, acrylic resin emulsion, polyester resin emulsion, polyurethane, and in particular, an emulsion resin which is synthesized by soap-free emulsion polymerization) may be used.

In order to adjust resistivity, conductive material particles may be further contained in the resin, and in order to prevent deterioration, an antioxidizing agent may be further contained in the resin. In addition, in order to improve film forming properties at the time of forming the covering layer, a leveling agent or a surfactant may be contained in the emulsion resin.

The resistance of the member for contact charging described above is preferably in a range of $10^2$ Ωcm to $10^{14}$ Ωcm, and is more preferably in a range of $10^2$ Ωcm to $10^{12}$ Ωcm. In addition, the electric voltage applied to the member for contact charging may be applied in the form of a direct current, or a direct current+alternate current.

Exposure Device

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range of the spectral sensitivity of the electrophotographic photoreceptor. As the wavelengths of semiconductor lasers, near infrared rays having emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a developer is contacted or not contacted for developing an image, may be used. Such a developing device 11 is not particularly limited as long as it has the above-described functions, and may be appropriately selected according to the intended use. Examples thereof include a known developing device in which the single-component or two-component developer is applied to the electrophotographic photoreceptor 7 using a brush or a roller. Among these, the developing device using developing roller retaining developer on the surface thereof is preferable.

The developer used in the developing device 11 may be a single-component developer formed of a toner singly or a two-component developer formed of a toner and a carrier. Further, the toner may be magnetic or non-magnetic. As the developer, known ones may be applied.

Cleaning Device

As the cleaning device 13, a cleaning blade type device provided with the cleaning blade 131 is used.

Further, in addition to the cleaning blade type, a fur brush cleaning type and a type of performing developing and cleaning at once may also be employed.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a belt-shaped member (intermediate transfer belt) including polyimide, polyamideimide, polycarbonate, polyarylate, polyester, rubber, or the like, which is imparted with the semiconductivity, is used. In addition, the intermediate transfer member may also take the form of a drum, in addition to the form of a belt.

Figure 7:
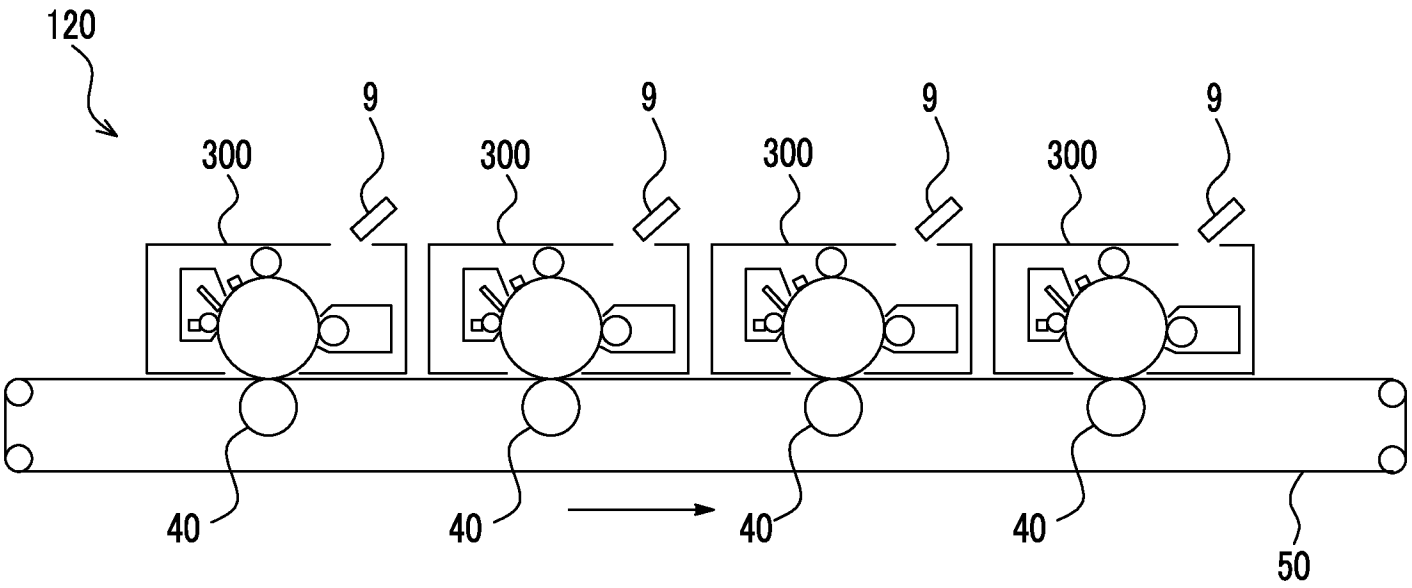
FIG. 7 is a schematic configuration diagram showing another example of the image forming apparatus according to the present exemplary embodiment.

FIG. 7 is a schematic configuration diagram showing another example of the image forming apparatus according to the present exemplary embodiment.

The image forming apparatus 120 shown in FIG. 7 is a tandem type multi color image forming apparatus equipped with four process cartridges 300. In the image forming apparatus 120, four process cartridges 300 are provided parallel with each other on the intermediate transfer member 50, and one electrophotographic photoreceptor may be used for one color. Further, the image forming apparatus 120 has the same configuration as the image forming apparatus 100, except that it is a tandem type.

Furthermore, the image forming apparatus 100 according to this exemplary embodiment is not limited to the configuration described above, and the image forming apparatus 100 may include, for example, around the electrophotographic photoreceptor 7, a first erasing device for easily removing remaining toner with a cleaning brush by aligning polarities of the toner, provided on a downstream side of the transfer device 40 in a rotation direction of the electrophotographic photoreceptor 7 and on an upstream side of the cleaning device 13 in the rotation direction of the electrophotographic photoreceptor, or a second erasing device for erasing the surface of the electrophotographic photoreceptor 7, provided on the downstream side of the cleaning device 13 in the rotation direction of the electrophotographic photoreceptor and on the upstream side of the charging device 8 in the rotation direction of the electrophotographic photoreceptor.

In addition, the image forming apparatus 100 according to this exemplary embodiment is not limited to the configuration described above, and a known configuration, for example, a direct transfer type image forming apparatus may be adopted in which the toner image formed on the electrophotographic photoreceptor 7 is directly transferred onto the recording medium.

EXAMPLES

Hereinafter, this exemplary embodiment will be described in detail with reference to examples, but this exemplary embodiment is not limited to these examples. Furthermore, in the following description, "parts" and "%" are on a weight basis unless particularly stated otherwise.

Example 1

Formation of Undercoat Layer 100 parts by weight of zinc oxide particles (a trade name: MZ-300, manufactured by Tayca Corporation), 10 parts by weight of N-β(aminoethyl)γ-aminopropyl triethoxy silane (a toluene solution of 10% by weight) as a silane coupling agent, and 200 parts by weight of toluene are mixed and stirred, and are refluxed for 2 hours. After that, the toluene is subjected to reduced pressure-distillation at 10 mmHg, and a baking surface treatment is performed at 135° C. for 2 hours.

33 parts by weight of the zinc oxide particles which have been subjected to the surface treatment, 6 parts by weight of blocked isocyanate (a trade name: Sumidur 3175, manufactured by Sumitomo Bayer Urethane Co., Ltd.), and 25 parts by weight of methyl ethyl ketone are mixed and dispersed for 30 minutes. After that, 5 parts by weight of a butyral resin (a trade name: S-LEC BM-1, manufactured by Sekisui Chemical Co., Ltd.), 3 parts by weight of a silicone ball (a trade name: Tospearl 120, manufactured by Momentive Performance Materials Inc.), and 0.01 parts by weight of silicone oil (a trade name: SH29PA, manufactured by Dow Corning Toray Co., Ltd.) as a leveling agent are further added and dispersed for 6 hours by using a sand mill, and thus a dispersion A1 is obtained.

Next, a dispersion B1 is obtained by the same method as that of the dispersion A1 except that the dispersion time of the sand mill is 3 hours. Then, the dispersion A1 and the dispersion B1 are mixed together such that a weight ratio r of the solid content of the zinc oxide particles which have been subjected to the surface treatment in the dispersion A1 is a value shown in Table 1, and thus a coating liquid for forming an undercoat layer is obtained.

The coating liquid for forming an undercoat layer is applied onto an aluminum substrate (a conductive substrate) having a diameter of 30 mm, a length of 340 mm, and a thickness of 0.71 mm by using a dipping coating method, and dry curing is performed at 180° C. for 30 minutes, and thus an undercoat layer having a thickness of 23.5 μm is obtained.

Formation of Charge Generating Layer 18 parts by weight of a hydroxygallium phthalocyanine pigment as a charge generating material, 16 parts by weight of a vinyl chloride-vinyl acetate copolymer resin (a trade name: VMCH, manufactured by NUC Corporation) as a binder resin, and 100 parts by weight of n-butyl acetate are mixed together, and thus a mixture is obtained. The mixture is mixed with 1.0 mmϕ glass beads at a filling rate of 50% in a glass bottle having capacity of 100 mL, and is subjected to a dispersion treatment for 2.5 hours by using a paint shaker, and thus a coating liquid for forming a charge generating layer is obtained. The obtained application liquid for forming a charge generating layer is applied onto the undercoat layer which is formed as described above by dip coating, and is dried at 100° C. for 5 minutes, and thus a charge generating layer having a film thickness of 0.20 μm is formed.

Formation of Charge Transport Layer 2 parts by weight of a compound denoted by Expression (a-1A) described later, 2 parts by weight of a compound denoted by Expression (a-2A) described later, and 6 parts by weight of a bisphenol Z polycarbonate resin (a viscosity average molecular weight of 40000) are added to 60 parts by weight of tetrahydrofuran and are dissolved, and thus a coating liquid for forming a charge transport layer is obtained. The coating liquid for forming a charge transport layer is applied onto the charge generating layer which is formed as described above, is dried at 150° C. for 30 minutes, and a charge transport layer having a film thickness of 24 μm is formed, and thus a photoreceptor 1 is prepared.

(a-1A)

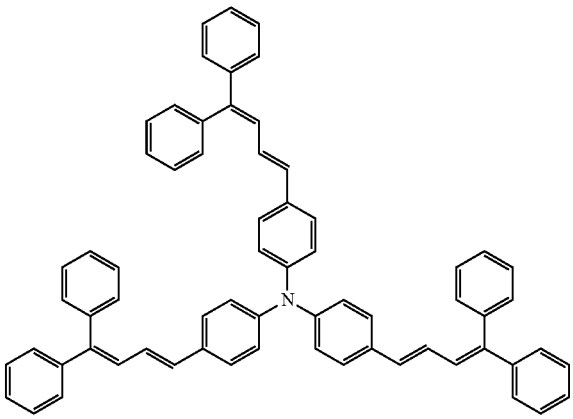

(a-2A)

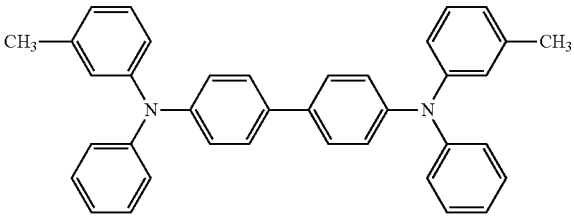

Example 2

A photoreceptor is prepared by the same method as that in Example 1 except that the dispersion A1 and the dispersion B1 are mixed together such that the weight ratio r of the solid content of the zinc oxide particles which have been subjected to the surface treatment in the dispersion A1 is changed to a value shown in Table 1, and thus a photoreceptor 2 is obtained.

Example 3

A photoreceptor is prepared by the same method as that in Example 1 except that the undercoat layer is formed as follows, and thus a photoreceptor 3 is obtained.

Formation of Undercoat Layer 100 parts by weight of zinc oxide particles (a trade name: MZ-300, manufactured by Tayca Corporation), 10 parts by weight of N-β(aminoethyl)γ-aminopropyl triethoxy silane (a toluene solution of 10% by weight) as a silane coupling agent, and 200 parts by weight of toluene are mixed and stirred, and are refluxed for 2 hours. After that, the toluene is subjected to reduced pressure-distillation at 10 mmHg, and a baking surface treatment is performed at 135° C. for 2 hours.

33 parts by weight of the zinc oxide particles which have been subjected to the surface treatment, 6 parts by weight of blocked isocyanate (a trade name: Sumidur 3175, manufactured by Sumitomo Bayer Urethane Co., Ltd.), 1 part by weight of a compound denoted by Illustrative Compound (1-9) described above, and 25 parts by weight of methyl ethyl ketone are mixed together, and dispersed for 30 minutes. After that, 5 parts by weight of a butyral resin (a trade name: S-LEC BM-1, manufactured by Sekisui Chemical Co., Ltd.), 3 parts by weight of a silicone ball (a trade name: Tospearl 120, manufactured by Momentive Performance Materials Inc.), and 0.01 parts by weight of silicone oil (a trade name: SH29PA, manufactured by Dow Corning Toray Co., Ltd.) as a leveling agent are further added and dispersed for 6 hours by using a sand mill, and thus a dispersion A2 is obtained.

Next, a dispersion B2 is obtained by the same method as that of the dispersion A2 except that the dispersion time of the sand mill is 3 hours. Then, the dispersion A2 and the dispersion B2 are mixed together such that the weight ratio r of the solid content of the zinc oxide particles which have been subjected to the surface treatment in the dispersion A2 is the value shown in Table 1, and thus a coating liquid for forming an undercoat layer is obtained.

The coating liquid for forming an undercoat layer is applied onto an aluminum substrate having a diameter of 30 mm, a length of 340 mm, and a thickness of 0.71 mm by using a dipping coating method, and dry curing is performed at 180° C. for 30 minutes, and thus an undercoat layer having a thickness of 23.5 μm is obtained.

Examples 4 to 13

Photoreceptors are prepared by the same method as that in Example 3 except that the dispersion A2 and the dispersion B2 are mixed together such that the weight ratio r of the solid content of the zinc oxide particles which have been subjected to the surface treatment in the dispersion A2 is the value shown in Table 1, and the film thickness of the undercoat layer is changed to the value shown in Table 1, and thus photoreceptor 4 to photoreceptor 13 are obtained.

Example 14

A photoreceptor is prepared by the same method as that in Example 3 except that Illustrative Compound (1-12)

described above is used instead of the compound denoted by Illustrative Compound (1-9) described above, and thus a photoreceptor 14 is obtained.

Comparative Examples 1 to 5

Photoreceptors are prepared by the same method as that in Example 3 except that the dispersion A2 and the dispersion B2 are mixed together such that the weight ratio r of the solid content of the zinc oxide particles which have been subjected to the surface treatment in the dispersion A2 is changed to the value shown in Table 1, and thus photoreceptor C1 to photoreceptor C5 are obtained.

Comparative Example 6

Formation of Undercoat Layer 38 parts by weight of a solution in which 60 parts by weight of zinc oxide particles (an average particle diameter: 70 nm, manufactured by Tayca Corporation), 13.5 parts by weight of blocked isocyanate (a trade name: Sumidur 3173, manufactured by Sumitomo Bayer Urethane Co., Ltd.), and 15 parts by weight of butyral resin (a trade name: S-LEC BM-1, manufactured by Sekisui Chemical Co., Ltd.) are dissolved in 85 parts by weight of methyl ethyl ketone, and 25 parts by weight of methyl ethyl ketone are mixed together, and are dispersed for 4 hours by using glass beads having a diameter of 1 mm in a sand mill, and thus a dispersion is obtained. 0.005 parts by weight of dioctyl tin dilaurate as a catalyst, and 4.0 parts by weight of silicone resin particles (a trade name: Tospearl 145, manufactured by Momentive Performance Materials Inc.) are added to the obtained dispersion, and thus a coating liquid for forming an undercoat layer is obtained. The coating liquid for forming an undercoat layer is applied onto an aluminum substrate having a diameter of 30 mm by using a dipping coating method, and dry curing is performed at 170° C. for 24 minutes, and thus an undercoat layer having a thickness of 15 μm is formed.

Formation of Charge Generating Layer 15 parts by weight of a chlorogallium phthalocyanine crystal as a charge generating material, 10 parts by weight of a vinyl chloride-vinyl acetate copolymer resin (a trade name: VMCH, manufactured by NUC Corporation), and 300 parts by weight of n-butyl alcohol are mixed together, and thus a mixture is obtained. The mixture is dispersed for 4 hours by using glass beads having a diameter of 1 mm in a sand mill, and thus a coating liquid for forming a charge generating layer is obtained. The coating liquid for forming a charge generating layer is applied onto the undercoat layer formed as described above by dip coating, and is dried, and thus a charge generating layer having a thickness of 0.2 μm is formed.

Formation of Charge Transport Layer 8 parts by weight of tetrafluoroethylene resin particles (an average particle diameter: 0.2 μm), and 0.01 parts by weight of a fluorinated alkyl group-containing methacryl copolymer (a weight average molecular weight of 30000) are stirred and mixed with 4 parts by weight of tetrahydrofuran and 1 part by weight of toluene for 48 hours while maintaining a liquid temperature at 20° C., and thus a tetrafluoroethylene resin particle suspension X is obtained.

4 parts by weight of N,N'-diphenyl-N,N'-bis(3-methyl phenyl)-[1,1']biphenyl-4,4'-diamine as a charge transporting substance, 6 parts by weight of a bisphenol Z polycarbonate resin (a viscosity average molecular weight: 40000), and 0.1 parts by weight of 2,6-di-t-butyl-4-methyl phenol as an antioxidizing agent are mixed together, and a mixture is mixed and dissolved in 24 parts by weight of tetrahydrofuran and 11 parts by weight of toluene, and thus a mixed solution Y is obtained.

The resin particle suspension X is added to the mixed solution Y, and is stirred and mixed, and then a pressure increases up to 500 kgf/cm$^2$ by using a high pressure homogenizer (manufactured by Yoshida Kikai Co., Ltd.), 5 ppm of fluorine-modified silicone oil (a trade name: FL-100, manufactured by Shin-Etsu Chemical Co., Ltd.) is added to a solution which has been repeatedly subjected to a dispersion treatment 6 times, and the solution is stirred, and thus a coating liquid for forming a charge transport layer is obtained. 21.0 μm of the coating liquid is applied onto the charge generating layer, is dried at 140° C. for 25 minutes, and a charge transport layer is formed, and thus a photoreceptor C6 is prepared.

Comparative Example 7

Formation of Undercoat Layer 100 parts by weight of zinc oxide particles (an average particle diameter of 70 μm), and 500 parts by weight of toluene are stirred and mixed, and a mixture is added with 1.5 parts by weight of a silane coupling agent (a trade name: KBM603, manufactured by Shin-Etsu Chemical Co., Ltd.), followed by stirring for 2 hours. After that, the toluene is subjected to reduced pressure-distillation, and baking is performed at 150° C. for 2 hours.

Next, 60 parts by weight of zinc oxide particles which have been subjected to a surface treatment, 15 parts by weight of blocked isocyanate (Sumidur 3175 manufactured by Sumitomo Bayer Urethane Co., Ltd.), 15 parts by weight of a butyral resin (a trade name: S-LEC BM-1, manufactured by Sekisui Chemical Co., Ltd.), and 85 parts by weight of methyl ethyl ketone are mixed together. 38 parts by weight of the obtained mixed liquid and 25 parts by weight of methyl ethyl ketone are mixed together, and are dispersed for 2 hours by using glass beads of 1 mmϕ in a sand mill, and thus a dispersion is obtained.

0.005 parts by weight of dioctyl tin dilaurate as a catalyst, and 0.01 parts by weight of silicone oil (a trade name: SH29PA, manufactured by Dow Corning Toray Co., Ltd.) are added to the obtained dispersion, and thus a coating liquid for forming an undercoat layer is obtained. The coating liquid for forming an undercoat layer is applied onto an aluminum substrate having a diameter of 30 mm, a length of 340 mm, and a thickness of 1 mm by using a dipping coating method, and dry curing is performed at 160° C. for 100 minutes, and thus an undercoat layer having a thickness of 20 μm is formed.

Formation of Charge Generating Layer 15 parts by weight of gallium chloride phthalocyanine as a charge generating substance, 10 parts by weight of a vinyl chloride-vinyl acetate copolymer resin (a trade name: VMCH, manufactured by NUC Corporation), and 300 parts by weight of n-butyl alcohol are mixed together, and thus a mixture is obtained. The mixture is dispersed for 4 hours by using glass beads of 1 mmϕ in a sand mill, and thus a coating liquid for forming a charge generating layer is obtained. The coating liquid for forming a charge generating layer is applied onto the undercoat layer formed as described above by dip coating, and is dried, and thus a charge generating layer having a thickness of 0.2 μm is formed.

Formation of Charge Transport Layer

Further, 4 parts by weight of N,N'-diphenyl-N,N'-bis(3-methylphenyl)-[1,1']biphenyl-4,4'-diamine, and 6 parts by weight of a bisphenol Z polycarbonate resin (a viscosity average molecular weight of 40000) are added to 80 parts by weight of chlorobenzene, and are dissolved, and thus a coating liquid for forming a charge transport layer is obtained. The coating liquid for forming a charge transport layer is applied onto the charge generating layer formed as described above by dip coating, is dried at 130° C. for 40 minutes, and a charge transport layer having a thickness of 25 μm is formed, and thus a photoreceptor C7 is prepared.

Evaluation

Measurement of Angular Frequency ωMax of Undercoat Layer

Measurement of an angular frequency ωmax of the undercoat layer is performed with respect to the electrophotographic photoreceptor of each example by the method described above.

Evaluation of Image Quality

The electrophotographic photoreceptor obtained in each example is mounted on an electrophotographic image forming apparatus (manufactured by Fuji Xerox Co., Ltd.: DocuCentre-IV C2263), and image quality evaluation is performed. The results thereof are shown in Table 1.

First, an entire surface halftone image (Magenta) having a density of 30% is printed on one piece of A3-sized paper, and the image quality evaluation (evaluation of an abnormal discharge image quality defect and evaluation of a decrease in image quality density) is performed. Next, an entire surface halftone image (Magenta) having a density of 30% is continuously output on 3000 pieces of A3-sized paper, and then an entire surface halftone image (Magenta) having a density of 30% is output on one piece of A3-sized paper, and thus the image quality evaluation (the evaluation of the abnormal discharge image quality defect and the evaluation of the decrease in the image quality density) described above is performed.

The evaluation of the abnormal discharge image quality defect and the evaluation of the decrease in the image quality density are determined by visual observation. The determination is performed in increments of G1 in 6 steps of G0 to G5, and the numerical value of G indicates that the evaluation result of the image quality becomes more excellent as the numerical value decreases (that is, in a relationship such that (excellent) G0>G1>G2>G3>G4>G5 (deteriorated)). In addition, in the evaluation of the abnormal discharge image quality defect and the evaluation of the decrease in the image quality density, an acceptable range is less than or equal to G3. An evaluation criterion is as follows.

Evaluation Criteria

G0: The abnormal discharge image quality defect and the decrease in the image quality density are not observed G1: The abnormal discharge image quality defect and the decrease in the image quality density are rarely observed G2: The abnormal discharge image quality defect and the decrease in the image quality density are very slightly observed G3: The abnormal discharge image quality defect and the decrease in the image quality density are slightly observed G4: The abnormal discharge image quality defect and the decrease in the image quality density are obviously observed G5: The abnormal discharge image quality defect and the decrease in the image quality density are extremely obviously observed

TABLE 1

| | | | | | | Image Quality Evaluation | | | |
|---|---|---|---|---|---|---|---|---|---|
| | | Specific | Weight Ratio | | Film Thickness of Undercoat | Abnormal Discharge Image Quality Defect | | Image Quality Density | |
| | Photoreceptor No. | AQ Compound | (r) % by Weight | ωmax (rad) | Layer (μm) | Initial | After Outputting 3000 Pieces of Paper | Initial | After Outputting 3000 Pieces of Paper |
| Example 1 | Photoreceptor 1 | Absent | 78 | 4.23 | 23.5 | G0 | G0 | G1 | G3 |
| Example 2 | Photoreceptor 2 | Absent | 58 | 4.95 | 23.5 | G1 | G1 | G0 | G2 |
| Example 3 | Photoreceptor 3 | Present | 78 | 4.53 | 23.5 | G0 | G0 | G1 | G1 |
| Example 4 | Photoreceptor 4 | Present | 58 | 5.24 | 23.5 | G1 | G1 | G0 | G0 |
| Example 5 | Photoreceptor 5 | Present | 49 | 7.23 | 23.5 | G2 | G2 | G0 | G0 |
| Example 6 | Photoreceptor 6 | Present | 30 | 9.55 | 23.5 | G3 | G3 | G0 | G0 |
| Example 7 | Photoreceptor 7 | Present | 49 | 7.25 | 22.8 | G3 | G3 | G0 | G0 |
| Example 8 | Photoreceptor 8 | Present | 49 | 7.48 | 24.7 | G2 | G2 | G0 | G0 |
| Example 9 | Photoreceptor 9 | Present | 49 | 7.19 | 25.3 | G1 | G1 | G0 | G0 |
| Example 10 | Photoreceptor 10 | Present | 49 | 7.21 | 29.5 | G1 | G1 | G0 | G0 |
| Example 11 | Photoreceptor 11 | Present | 49 | 7.22 | 30.3 | G0 | G0 | G0 | G0 |
| Example 12 | Photoreceptor 12 | Present | 49 | 7.24 | 34.5 | G0 | G0 | G0 | G0 |
| Example 13 | Photoreceptor 13 | Present | 86 | 2.21 | 23.5 | G0 | G0 | G2 | G3 |
| Example 14 | Photoreceptor 14 | Present | 78 | 4.96 | 23.5 | G1 | G1 | G0 | G2 |
| Comparative Example 1 | Photoreceptor C1 | Present | 27 | 10.23 | 23.5 | G4 | G5 | G0 | G0 |
| Comparative Example 2 | Photoreceptor C2 | Present | 19 | 20.12 | 23.5 | G4 | G5 | G0 | G0 |
| Comparative Example 3 | Photoreceptor C3 | Present | 14 | 39.87 | 23.5 | G5 | G5 | G0 | G0 |
| Comparative Example 4 | Photoreceptor C4 | Present | 90 | 1.98 | 23.5 | G0 | G0 | G0 | G4 |
| Comparative Example 5 | Photoreceptor C5 | Present | 100 | 1.75 | 23.5 | G0 | G0 | G1 | G5 |
| Comparative Example 6 | Photoreceptor C6 | Absent | *** | 10.89 | 15.0 | G4 | G4 | G1 | G5 |
| Comparative Example 7 | Photoreceptor C7 | Absent | *** | 11.24 | 20.0 | G5 | G5 | G1 | G5 |

From the results described above, it is found that excellent results are obtained with respect to the image quality evaluation in this example, compared to Comparative Example.

Furthermore, in Table 1, "Specific AQ Compound" indicates a "compound having an anthraquinone structure which has a hydroxyl group". In addition, in a section of the "Specific AQ Compound", "Absent" indicates that the specific AQ compound is not contained, and "Present" indicates that the specific AQ compound is contained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an undercoat layer provided on the conductive substrate and including metal oxide particles; and a photosensitive layer provided on the undercoat layer, wherein, at the time of performing Cole-Cole plot analysis with respect to the undercoat layer, an angular frequency $\omega max$, at which a maximum complex impedance component is obtained, falls within a range of 4 (rad)$\leq\omega max\leq$7.5 (rad), wherein the metal oxide particles are zinc oxide particles consisting of two portions, a first portion of the zinc oxide particles having a first diameter, and a second portion of the zinc oxide particles having a second diameter larger than that of the first diameter, and wherein a weight ratio r (%) of the first portion of zinc oxide particles in the undercoat layer is from 49% to 78% by weight with respect to the zinc oxide particles.

2. The electrophotographic photoreceptor according to claim 1, wherein powder resistance of the metal oxide particles falls within a range of $10^2$ Ωcm to $10^{11}$ Ωcm.

3. The electrophotographic photoreceptor according to claim 1, wherein the undercoat layer contains a binder resin, and a content of the metal oxide particles is from 10% by weight to 80% by weight with respect to the binder resin.

4. The electrophotographic photoreceptor according to claim 1, wherein the undercoat layer contains a binder resin, and a content of the metal oxide particles is from 40% by weight to 80% by weight with respect to the binder resin.

5. The electrophotographic photoreceptor according to claim 1, wherein the undercoat layer contains a compound having an anthraquinone structure that has a hydroxyl group.

6. The electrophotographic photoreceptor according to claim 1, wherein the undercoat layer contains a compound having an anthraquinone structure that has a hydroxyl group and an alkoxy group.

7. A process cartridge that comprises the electrophotographic photoreceptor according to claim 1, and is detachable from an image forming apparatus.

8. An image forming apparatus, comprising:

the electrophotographic photoreceptor according to claim 1;

a contact charging type charging unit charging a surface of the electrophotographic photoreceptor;

an electrostatic latent image forming unit forming an electrostatic latent image on the charged surface of the electrophotographic photoreceptor;

a developing unit developing the electrostatic latent image formed on the surface of the electrophotographic photoreceptor by using a developer including a toner to form a toner image; and a transfer unit transferring the toner image onto a surface of a recording medium.

* * * * *